United States Patent [19]

Takahashi et al.

[11] Patent Number: 5,061,525

[45] Date of Patent: Oct. 29, 1991

[54] SIZING METHOD

[75] Inventors: Yuichi Takahashi; Tsuneo Yasumura; Yasuo Ishii, all of Wakayama, Japan

[73] Assignee: Kao Corporation, Tokyo, Japan

[21] Appl. No.: 618,972

[22] Filed: Nov. 28, 1990

[30] Foreign Application Priority Data

Dec. 12, 1989 [JP] Japan ..... 1-322876

[51] Int. Cl.[5] ..... B05D 3/02

[52] U.S. Cl. ..... 427/389.9; 28/284; 427/392; 428/36.1

[58] Field of Search ..... 427/389.9, 392; 428/264, 265, 393, 395, 396, 36.1; 28/284

[56] References Cited

U.S. PATENT DOCUMENTS

| | | | |
|---|---|---|---|
| 3,948,673 | 4/1976 | Chase et al. | 106/711 |
| 4,663,163 | 5/1987 | Hou et al. | 210/198.2 |
| 4,964,915 | 11/1990 | Blixt et al. | 162/175 X |

FOREIGN PATENT DOCUMENTS

| | | |
|---|---|---|
| 58-180683 | 10/1983 | Japan . |
| 59-9275 | 1/1984 | Japan . |
| 62-61705 | 12/1987 | Japan . |
| 63-12195 | 3/1988 | Japan . |
| 1-33279 | 2/1989 | Japan . |
| 1046647 | 9/1964 | United Kingdom . |
| 1311231 | 9/1971 | United Kingdom . |

OTHER PUBLICATIONS

United Kingdom Search Report.

*Primary Examiner*—Michael Lusignan

*Attorney, Agent, or Firm*—Birch, Stewart, Kolasch & Birch

[57] ABSTRACT

A cheese of fiber can be effectively sized with an aqueous emulsion of a cationic polymer, containing 0.2 to 20 g/l of a water-soluble salt, at 30° to 80° C. The polymer preferably includes a copolymer of a vinyl monomer and an unsaturated carboxylic acid on a cationic polymer.

6 Claims, No Drawings

SIZING METHOD

BACKGROUND OF THE INVENTION

1. Field of the Invention

This invention relates to a method of sizing a cheese.

2. Description of Related Art

A cheese is obtained by winding a fiber, for example, cotton or blended yarns comprising cotton and polyester around a porous cylindrical core made of, for example, a synthetic resin in such a manner as to give a thickness of, for example, from 7 to 8 cm.

The sizing of the cheese is usually effected by introducing the cheese into a size tank and forcing a size in the tank to circulate from the internal layer of the cheese to the external layer thereof via the intermediate layer, or vice versa, through the core of the cheese.

Examples of the sizing agent to be used for sizing a cheese include those which are in the form of an aqueous solution of a polymer such as grafted starch (refer to Japanese Patent Laid-Open No. 33279/1989), etherified starch (refer to Japanese Patent Laid-Open No. 180683/1983), and a polymer compound having an average molecular weight of 20,000 or more which comprises a polyhydroxy compound having an average molecular weight of 1,000 or more as the main component (refer to Japanese Patent Laid-Open No. 9275/1984).

However these sizing agents of the aqueous polymer solution type have each some disadvantages such that it shows a poor adsorption efficiency and thus the sizing agent remains in the residue and that it requires a relatively high temperature (i.e., 80° to 90° C.) for gelatinization.

On the other hand, the use of a cationic emulsion polymer as a sizing agent enables the selective adsorption on a fiber, which serves to considerably save the amount of the sizing agent to be used.

However it is very difficult to make a cheese, which is a highly dense fiber aggregate, homogeneously adsorb a cationic emulsion polymer without giving any difference in the density among the internal, intermediate and external layers.

More specifically, a cheese is usually dyed at a temperature as high as 90° to 130° C. and then an unfixed dye is removed by soaping or reductive washing, followed by washing with hot or cold water. Since the sizing is conducted thereafter, the solution temperature in the sizing will never be lower than 30° C. When a cationic emulsion polymer is used as a sizing agent, therefore, it will undergo completely heterogeneous adsorption. Namely, the forced circulation of the size in the cheese from the internal layer to the external layer via the intermediate layer will cause the internal layer to adsorb most of the size. As a result, no size will adhere to the intermediate and external layers.

Although low temperature sizing methods have been proposed in order to solve the above-mentioned problems (refer to Japanese Patent Publication No. 61705/1987 and No. 12195/1988), they are seriously restricted from the industrial viewpoint for the reasons described above.

SUMMARY OF THE INVENTION

It is an object of the present invention to provide a sizing method wherein a cationic emulsion polymer useful as a sizing agent is employed within a temperature range of from 30° to 80° C. to thereby effect a homogeneous adsorption by a cheese.

DETAILED DESCRIPTION OF THE INVENTION

The present inventors have conducted extensive studies in order to enable homogeneous adsorption of a cationic emulsion polymer, which is used as a sizing agent, within a temperature range of from 30° to 80° C. As a result, they have found out that homogeneous adsorption can be achieved within the temperature range as specified above by using a cationic emulsion polymer together with a water-soluble salt, thus completing the present invention.

Accordingly, the present invention provides a method of sizing a cheese wherein a cheesy fiber is sized at a temperature of 30° to 80° C. by using an aqueous emulsion of a cationic polymer as a sizing agent, characterized in that said sizing agent contains 0.2 to 20 g/l of a water-soluble salt.

Particular examples of the water-soluble salt to be used in the present invention include alkali metal halides such as NaCl, alkali metal sulfates such as $Na_2SO_4$, alkali metal phosphates, alkali metal carbonates, alkali metal borates, alkali metal nitrates, alkaline earth metal halides such as $MgCl_2$, alkaline earth metal sulfates such as $MgSO_4$, alkaline earth metal phosphate, alkaline earth metal carbonates, alkaline earth metal borates, alkaline earth metal nitrates, alkaline earth metal salts of organic acids having 6 or less carbon atoms, such as formic acid, acetic acid, tartaric acid, citric acid and maleic acid, choline chloride and tetramethylammonium chloride. Among these compounds, sulfates and phosphates are particularly preferable from the viewpoint of preventing the formation of rust or scums in machinery.

The water-soluble salt may be used in an amount of from 0.2 to 20 g/l based on the aqueous emulsion of the cationic polymer as a sizing agent. When the content of the water-soluble salt is smaller than 0.2 g/l, no homogeneous adsorption can be achieved, while when it exceeds 20 g/l, on the other hand, the size becomes unstable.

Regarding the concentration of the sizing agent in the treatment, the bath ratio may preferably range from 1:7 to 1:15. The treatment can be effectively performed, in particular, at a concentration of 4% o.w.f. or below in terms of solid content.

Regarding the treatment temperature, the sizing is commonly effected at a temperature not lower than 30° C. When the temperature is 80° C. or above, the size becomes unstable. Thus the treatment temperature may preferably range from 30° to 80° C.

The cationic emulsion polymer to be used in the present invention is a copolymer obtained by copolymerizing a vinyl monomer with an unsaturated carboxylic acid in the presence of a cationic polymer, Examples of the vinyl polymer to be copolymerized include vinyl esters of lower fatty acids, such as vinyl acetate and vinyl propionate, among which vinyl acetate is particularly preferable. Examples of the unsaturated carboxylic acid to be copolymerized include acrylic acid, methacrylic acid, crotonic acid, maleic acid, fumaric acid, itaconic acid, aconitic acid, sorbic acid, cinnamic acid, α-chlorosorbic acid, citraconic acid and p-vinylbenzoic acid as well as half esters, partial esters and partial amides of unsaturated polycarboxylic acids such as itaconic acid, maleic acid and fumaric acid.

Examples of the cationic polymer to be added during or after the copolymerization of the above-mentioned vinyl monomer and unsaturated carboxylic acid include cationic cellulose, cationic starches (particularly preferably those which are soluble in water and have a quaternary ammonium cation as a cation group), cationic vinyl polymers and cyclized polymers of cationic diallyl compounds.

EXAMPLES

To further illustrate the present invention, and not by way of limitation, the following Examples will be given, wherein all parts are by weight. [Synthesis of cationic size base]

SYNTHETIC EXAMPLE 1

A five-necked separable flask provided with a nitrogen inlet, a stirrer, a device for constantly dropping a monomer, a thermometer and a reflux condenser was charged with 30 parts of trimethylaminohydroxypropylated starch represented by the following formula:

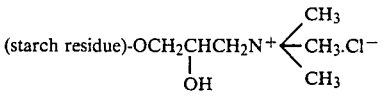

(nitrogen content: 0.6%; viscosity of 1% aqueous solution: 40 cp)

and 550 parts of deionized water. After dissolving at 80° C. and cooling to 60° C., a polymerization initiator comprising 20 parts of vinyl acetate, 0.5 part of 2,2'-azobis(2-amidinopropane) hydrochloride and 20 parts of deionized water was added thereto. Then the resulting mixture was heated to 70° C. so as to initiate the polymerization. 20 minutes after the initiation of the polymerization, a solution comprising 5 parts of crotonic acid and 395 parts of vinyl acetate was added dropwise thereto within 300 minutes. After the completion of the addition, the mixture was heated to 80° C. to thereby terminate the reaction.

SYNTHETIC EXAMPLE 2

The same apparatus as the one used in Synthetic Example 1 was charged with 7.5 parts of cationic starch (N=0.6), 1.2 parts of polyvinyl alcohol (degree of partial saponification: 79; degree of polymerization: 1600) and 100 parts of deionized water. After dissolving at 80° C. and cooled to 60° C., 10 parts of vinyl acetate, 4 parts of methacrylic acid and, if required, 2 parts of a nonionic surfactant, a cationic surfactant or a cationic monomer were added thereto. Further, 0.1 part of sodium carbonate, 0.1 part of 2,2'-azobis(2-amidinocyclopropane) hydrochloride or cumene hydroperoxide and 20 parts of deionized water were added thereto. Then the resulting mixture was heated to 70° C. so as to initiate the polymerization. 20 minutes after the initiation of the polymerization, 90 parts of vinyl acetate was added dropwise thereto within 300 minutes. After the completion of the addition, the mixture was heated to 80° C. to thereby terminate the reaction.

EXAMPLES 1 TO 5 AND COMPARATIVE EXAMPLES 1 AND 2

By using each of the sizing agents prepared in Synthetic Examples 1 and 2, a cheese was treated in the following manner. Then the amount of the adherent sizing agent, strength, elongation and cohesiveness were determined. Table 2 summarizes the results.

Treatment of Cheese

Each size containing a water-soluble salt, as specified in Table 1, was circulated from the internal layer of a cotton cheese yarn (20S, 1 kg-wound) to the external layer thereof via the intermediate layer thereof with the use of a cheese dyeing machine (mfd. by Nippon Senshoku Kikai K.K.) for 40 minutes, followed by hot-air drying at 105° C. for 60 minutes.

In each case, the amount of the sizing agent was 5% o.w.f, the bath ratio was 1:10, and the treatment temperature was 40° C.

The dried cheese was rewound and divided into the internal, intermediate and external layers to determine the amount of the adherent sizing agent (determined by extracting approximately 8 g of sized yarn with ethyl acetate with the use of a Soxhlet extractor for 4 hours), the strength, the elongation (determined with a tensilometer at a sample length of 100 mm and a tensile rate of 100 mm/min) and cohesiveness [determined with a TM-type cohesion tester by rubbing under a load of 400 g/19 yarns 400 and 1,000 times and then observing the fluffing of the treated yarns before and after the rubbing followed by evaluating in 5 grades (1: good—5: poor)] of each. layer.

TABLE 1

| | Sizing agent | Water-soluble salt | Salt concentration (g/l) |
|---|---|---|---|
| Ex. 1 | Syn. Ex. 1 | NaCl | 1 g/l |
| | Syn. Ex. 2 | NaCl | 1 g/l |
| Ex. 2 | Syn. Ex. 1 | NaCl | 5 g/l |
| | Syn. Ex. 2 | NaCl | 5 g/l |
| Ex. 3 | Syn. Ex. 1 | $Na_2SO_4$ | 5 g/l |
| | Syn. Ex. 2 | $Na_2SO_4$ | 5 g/l |
| Ex. 4 | Syn. Ex. 1 | $MgSO_47H_2O$ | 2 g/l |
| | Syn. Ex. 2 | $MgSO_47H_2O$ | 2 g/l |
| Ex. 5 | Syn. Ex. 1 | $MgSO_47H_2O$ | 25 g/λ |
| | Syn. Ex. 2 | $MgSO_47H_2O$ | 25 g/l |
| Comp. Ex. 1 | Syn. Ex. 1 | — | — |
| Comp. Ex. 2 | Syn. Ex. 2 | — | — |

TABLE 2

| | Sizing agent | Cheese layer | Adherent sizing agent (% o.w.f.) | Strength (g) | Elongation (%) | Cohesion (grade) |
|---|---|---|---|---|---|---|
| Ex. | | | | | | |
| 1 | Syn. | internal | 2.8 | 590 | 7.20 | 4 |
| | Ex. 1 | intermediate | 1.7 | 554 | 7.84 | 4 |
| | | external | 1.6 | 543 | 7.88 | 5 |
| | Syn. | internal | 2.7 | 587 | 7.20 | 4 |
| | Ex. 2 | intermediate | 1.9 | 550 | 7.84 | 4 |
| | | external | 1.5 | 538 | 7.88 | 5 |
| 2 | Syn. | internal | 2.0 | 573 | 7.20 | 3 |
| | Ex. 1 | intermediate | 1.9 | 557 | 7.84 | 4 |

TABLE 2-continued

| | Sizing agent | Cheese layer | Adherent sizing agent (% o.w.f.) | Strength (g) | Elongation (%) | Cohesion (grade) |
|---|---|---|---|---|---|---|
| | | external | 1.8 | 549 | 7.88 | 4 |
| | Syn. | internal | 2.1 | 565 | 7.20 | 3 |
| | Ex. 2 | intermediate | 1.8 | 573 | 7.84 | 4 |
| | | external | 1.9 | 556 | 7.88 | 4 |
| 3 | Syn. | internal | 2.2 | 586 | 7.20 | 3 |
| | Ex. 1 | intermediate | 2.0 | 574 | 7.84 | 4 |
| | | external | 1.9 | 562 | 7.88 | 4 |
| | Syn. | internal | 2.4 | 584 | 7.20 | 3 |
| | Ex. 2 | intermediate | 1.9 | 556 | 7.84 | 4 |
| | | external | 1.8 | 560 | 7.88 | 4 |
| 4 | Syn. | internal | 2.3 | 602 | 7.20 | 3 |
| | Ex. 1 | intermediate | 1.9 | 594 | 7.84 | 4 |
| | | external | 2.1 | 598 | 7.88 | 4 |
| | Syn. | internal | 2.2 | 607 | 7.20 | 3 |
| | Ex. 2 | intermediate | 1.9 | 617 | 7.84 | 4 |
| | | external | 2.0 | 619 | 7.88 | 4 |
| 5 | Syn. | internal | 3.7 | 620 | 7.29 | 3 |
| | Ex. 1 | intermediate | 1.4 | 543 | 7.95 | 4 |
| | | external | 0.3 | 506 | 7.88 | 5 |
| | Syn. | internal | 3.9 | 620 | 7.34 | 3 |
| | Ex. 2 | intermediate | 1.2 | 541 | 7.96 | 5 |
| | | external | 0.1 | 502 | 7.89 | 5 |
| Comp. Ex. | | | | | | |
| 1 | Syn. | internal | 3.8 | 595 | 6.80 | 4 |
| | Ex. 1 | intermediate | 1.5 | 536 | 7.63 | 5 |
| | | external | 0.2 | 507 | 7.45 | 5 |
| 2 | Syn. | internal | 3.7 | 589 | 6.75 | 4 |
| | Ex. 2 | intermediate | 1.6 | 540 | 7.50 | 5 |
| | | external | 0.7 | 510 | 7.63 | 5 |

RESULTS

As Table 2 clearly shows, each of the sizing agents obtained in Synthetic Examples 1 and 2 could hardly achieve homogeneous adsorption when employed alone (refer to Comparative Examples 1 and 2). In contrast, each system comprising a water-soluble salt (refer to Examples 1 to 5) shows homogeneous adsorption of the sizing agent without showing any significant difference among the internal, intermediate and external layers.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method of sizing a cheesy fiber at a temperature of 30° to 80° C. by using an aqueous emulsion of a cationic polymer as a sizing agent, wherein said sizing agent contains 0.2 to 20 g/l of a water-soluble salt.

2. A sizing method according to claim 1, wherein said cationic polymer is obtained by copolymerizing a vinyl monomer with an unsaturated carboxylic acid in the presence of a cationic polymer.

3. A sizing method according to claim 2, wherein said cationic polymer is a cationic starch.

4. A sizing method according to claim 3, wherein said cationic starch has a quaternary ammonium cation as the cationic group.

5. A sizing method according to claim 1, wherein said water-soluble salt is selected from the group consisting of alkali metal halide, alkali metal sulfates, alkali metal phosphates, alkaline earth metal halides, alkaline earth metal sulfates, and alkaline earth metal phosphates.

6. A sizing method according to claim 5, wherein said water-soluble salt is selected from the group consisting of sodium chloride, sodium sulfate, and magnesium sulfate.

* * * * *